United States Patent [19]

Selken

[11] Patent Number: 4,768,454

[45] Date of Patent: Sep. 6, 1988

[54] FOLDING WHEELED BOAT

[76] Inventor: Jerry J. Selken, 1056 Via Verona Dr., Chico, Calif. 95926

[21] Appl. No.: 12,343

[22] Filed: Feb. 9, 1987

[51] Int. Cl.[4] ..... B63B 1/12

[52] U.S. Cl. ..... 114/61; 114/344; 114/353; 114/363

[58] Field of Search ..... 114/344, 352, 353, 363, 114/61, 123; 440/6, 7

[56] References Cited

U.S. PATENT DOCUMENTS

| | | | |
|---|---|---|---|
| 1,850,669 | 3/1932 | Harvey | 114/162 |
| 2,570,528 | 10/1951 | Davis | 114/353 |
| 3,126,558 | 3/1964 | Nolan et al. | 114/352 |
| 3,200,420 | 8/1965 | Palus | 114/352 |
| 3,684,139 | 8/1972 | Johnson | 114/353 |
| 3,858,541 | 1/1975 | Metcalf et al. | 114/352 |
| 4,124,910 | 11/1978 | Raymond | 114/363 |
| 4,537,144 | 8/1985 | Horton | 440/7 |

FOREIGN PATENT DOCUMENTS

| | | | |
|---|---|---|---|
| 1167657 | 10/1969 | United Kingdom | 114/352 |
| 1336307 | 11/1973 | United Kingdom | 114/353 |

*Primary Examiner*—Joseph F. Peters, Jr.
*Assistant Examiner*—Stephen P. Avila
*Attorney, Agent, or Firm*—Mark C. Jacobs

[57] ABSTRACT

A compact portable folding boat comprising a mid section with a wheel coupled to the front of the mid section. The boat has sections hinged to each side of the mid section which fold up over the mid section for storage. The boat can be rolled on the wheel in a folded position, then opened to a fully operative position and a motor may be clamped onto the transom of the mid section. The interior of each section may be used to store various components of a boat and a collapsible chair may also be provided.

14 Claims, 7 Drawing Sheets

FOLDING WHEELED BOAT

BACKGROUND OF THE INVENTION

1. Field of the Invention

The invention relates to portable collapsible boats.

2. Description of the Prior Art

Water sports have always been popular and one such sport that has increased in popularity over the years is boating. Boats are useful and necessary for getting to those hard-to-reach fishing spots and, of course, essential for some types of fishing, such as trolling. However, such boats are expensive and must be transported to the fishing location. Also, boats of a larger size are difficult to store at home.

There is a need for a boat that can be easily stored, then transported to a desired area and quickly and easily be erected for fishing or the like. Such a boat must be light in weight and strong enough to support a small motor and at least one operator.

SUMMARY OF THE INVENTION

It is an object of this invention to provide a portable collapsible boat.

It is a further object of this invention to provide such a boat which can be stored, transported to a desired location and quickly and easily erected for use.

It is a further object of this invention to carry out the foregoing objects where the boat is strong enough to support at least one operator and a small motor.

These and other objects are preferably accomplished by providing a compact portable folding boat comprising a midsection with a wheel coupled to the front of the midsection. The boat has sections hinged to each side of the midsection which drop down to form a complete boat or fold up over the midsection for storage. The boat can be lifted up and rolled on the front wheel when in its folded condition, then opened to a fully operative position and a motor may be clamped onto the transom of the midsection. The interior of each section may be used to store various components of a boat and a collapsible chair may also be provided. A slave unit may be provided for attachments to the main unit.

DESCRIPTION OF THE PREFERRED EMBODIMENT

Figure 1:
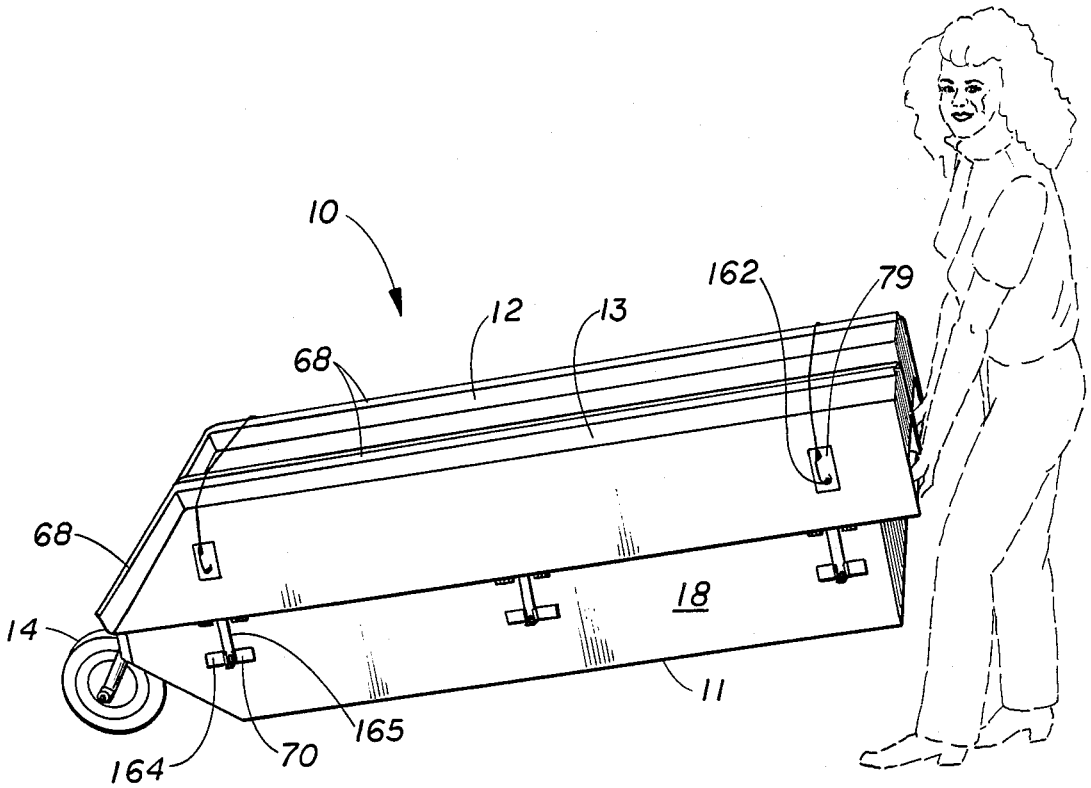
FIG. 1 is a perspective view of a boat in accordance with the teachings of the invention shown in its fully folded position.

Referring now to FIG. 1 of the drawing, a boat 10 in accordance with the invention is shown having a main center section 11 (see also FIG. 2), a pair of folding side sections 12, 13 and a wheel 14.

Figure 3:
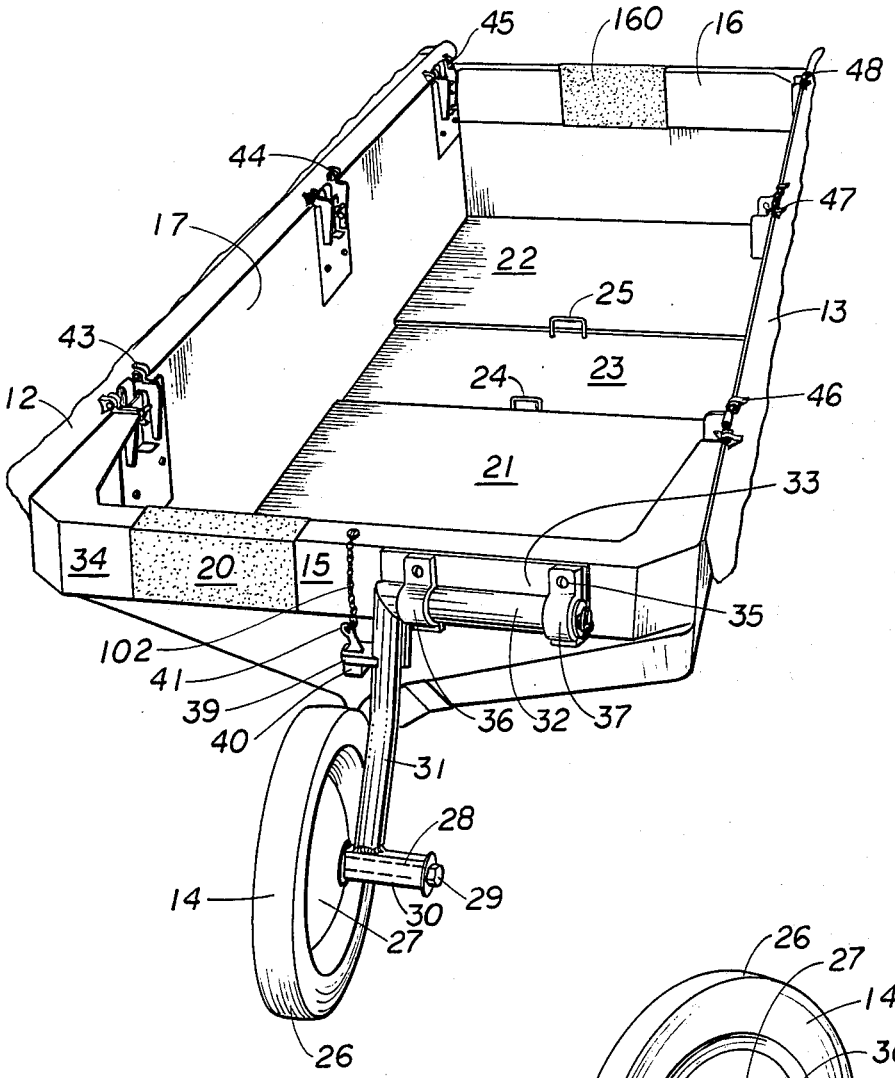
FIG. 3 is a top plan view of a portion of the boat of FIGS. 1 and 2 showing in detail the center section thereof with parts of the boat omitted for convenience of illustration.
Figure 4:
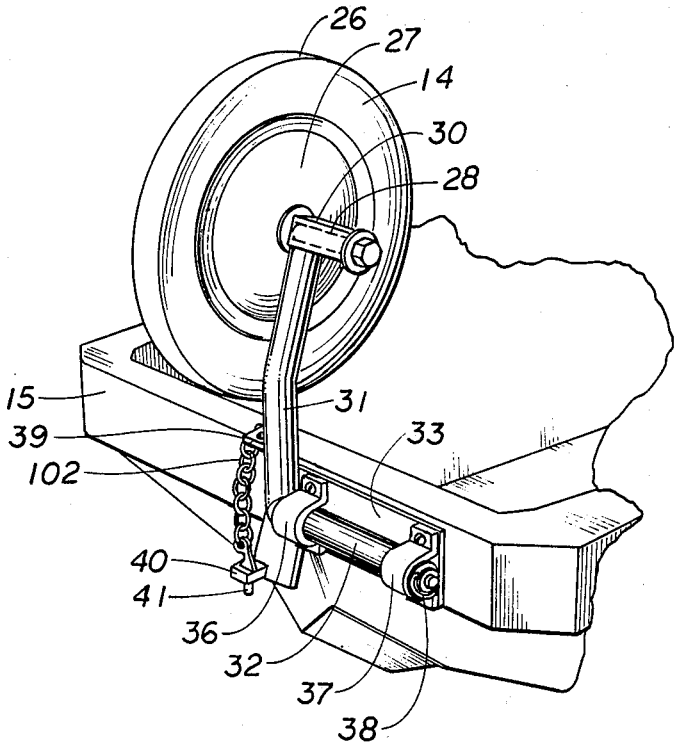
FIG. 4 is a perspective view of a portion of the apparatus of FIG. 3 showing the wheel of the boat in a raised inoperative position.

The center section 11 is shown in detail in FIG. 3 as having a front and rear wall 15, 16, respectively, with interconnected flat side walls 17, 18, as shown. A flat bottom wall 19 closes off the bottom of the center section 11 thereby forming an open preferably box-like rectangular structure. The undersurface of wall 19 is also flat. As seen in FIG. 4 the front wall 15 of center section 11 is set back about 2" behind the adjacent front walls of side sections 12, 13 to provide a built in splash shield.

A motor mount area 20, which may have a roughened surface, is provided on front wall 15 for securing a conventional small trolling or outboard motor 42 (FIG. 2) thereto. Thus, front wall 15 is the equivalent of a boat transom and may be provided at the other side of the centerline of center section 11 with a like roughened area so the motor 42 may be mounted on either the port or starboard side (and, if desired, such motor mount areas 160 may be provided additionally on the rear wall 16.

Bottom wall 19 is flat and may be provided with carpeted areas 21, 22 at the front and back of boat 10 with an area left bare or strengthened with a metallic battery plate 23 for mounting a battery (not shown) thereon. A pair of upstanding ears 24, 25 forming abutment members and tie down means may be provided on each side of plate 23 as shown.

Wheel 14 is comprised of a tire 26, which may be a solid rubber tire, mounted on a hub 27 receiving therein at the axial center thereof a shaft 28 (see the dashed lines in FIG. 3). Shaft 28 extends into hub 27, having a nut 29 on one end thereof, and into an arm 30 extending normal to an elongated arm 31 having a second portion 32 extending normal to arm 31 and parallel to arm 30. Any suitable means may be providing for securing wheel 14 to arm 30 so that it rotates thereon. Thus, suitable nuts and bolts may be used with internal bearings as desired.

A mounting plate 33 is secured to the front face of front wall 15 by suitable screws 35 or the like passing through a pair of spaced U-shaped flanges 36, 37, and into face 34 of front wall 15 as shown. Arm portion 32 extends between flanges 36, 37, as shown, and rotates therein. Any suitable means may be provided at the free end of arm portion 32, such as a pivoted stop ring 38, as is well known in the art, for preventing arm portion 32 from sliding out of flanges 36, 37, until ring 38 is pivoted to a position aligned with the axis of arm portion 32.

The wheel 14 may be locked in position by providing an apertured flange 39 on arm 31 adapted to engage an apertured flange 40 on plate 33 receiving a headed pin 41 through the aligned apertures of flange 39 and flange 40 for locking the flanges 39, 40 together. Of course, any suitable releasable lock means may be provided. Thus, pin 41 may be removed and wheel 14 can be selectively raised from the operative FIG. 3 position by rotation of arm portion 32 within flanges 36, 37 to the stored inoperative position shown in FIG. 4 where tire 26 rests on the top of front wall 15.

As seen in FIG. 3, a chain 102 may be secured to wall 15 at any suitable location and to pin 41 to prevent loss thereof.

Figure 5:
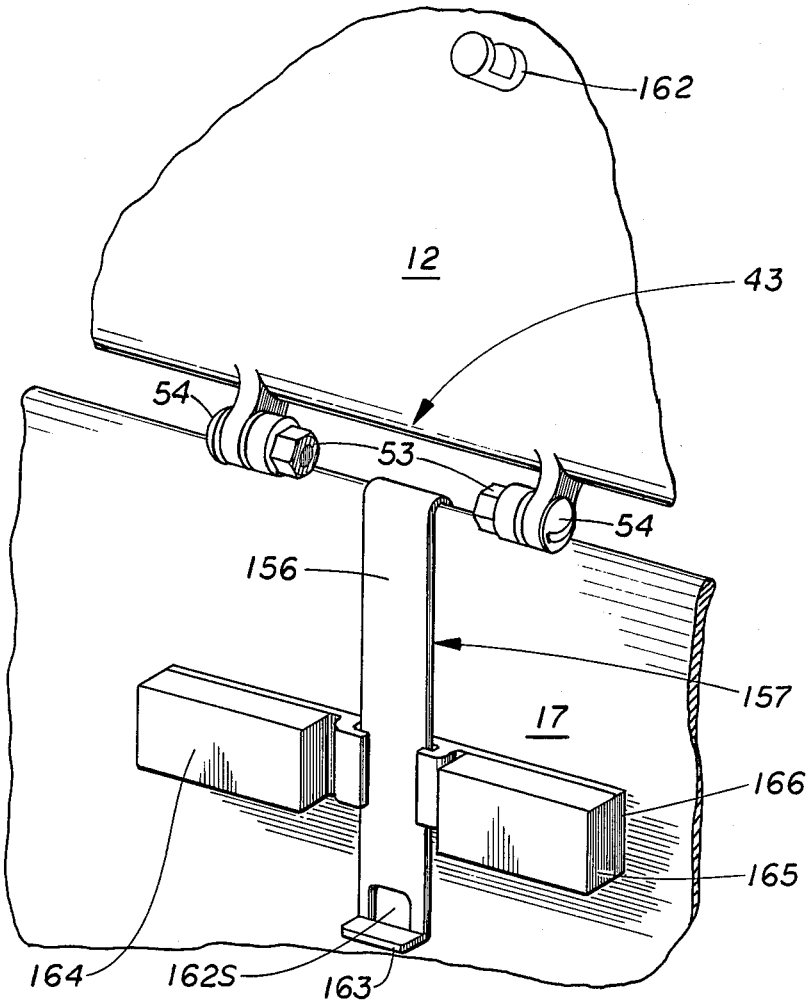
FIG. 5 is a detailed view of the connection of one of the side sections of the boat of FIGS. 1 to 4 to the main center section.
Figure 6:
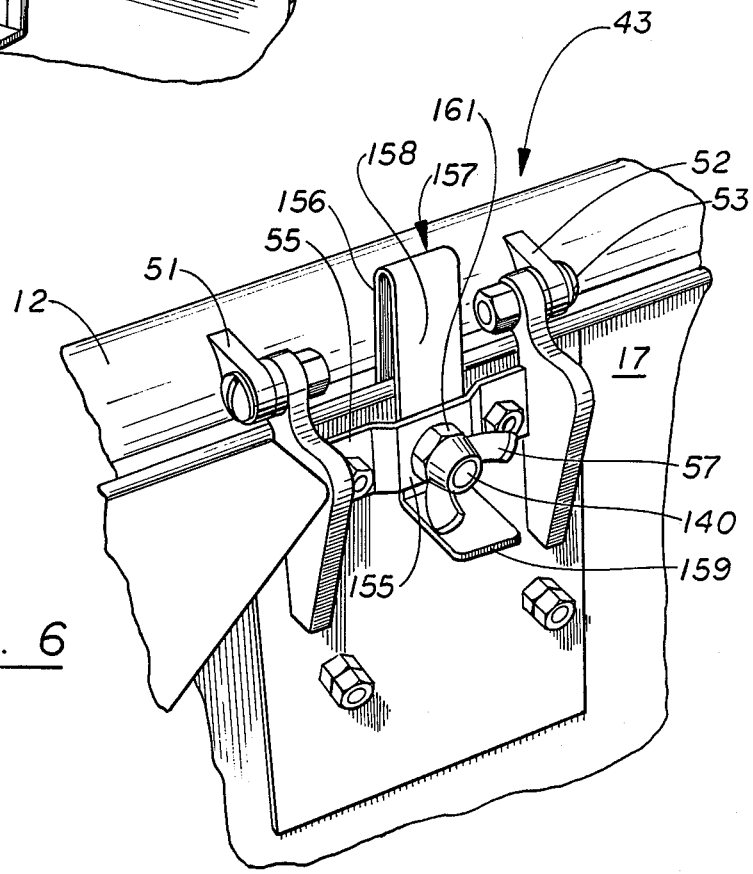
FIG. 6 is a detailed view of the circled portion of FIG. 3.

As seen in FIG. 3, and elsewhere a plurality, such as three, spaced mechanism assemblies (43, 44 and 45 along side wall 17 and 46, 47 and 48 along side wall 18) are provided along each side wall 17 or 18 riveted or otherwise secured thereto as seen in detail in FIG. 6 (assembly 43 being shown). Thus, in FIG. 6 a pair of spaced flanges 49, 50 are welded to or otherwise extend from wall 17. A pair of spaced flanges 51, 52 extend from each side section 12 or 13 (see also FIG. 5). The spacing between flanges 49, 50, 51 and 52 are such that they intermesh as shown and are apertured at their point of contacts for receiving therethrough suitable nuts and bolts 53, 54, respectively, as shown. In this manner, side sections 12 and 13 pivot about nuts and bolts 53, 54 so that each section 12, 13 can be moved from the FIG. 2 to the FIG. 1 position for storage and transport. As seen in FIG. 6, additional support may be provided by providing a stiffener 55 extending between flanges 49, 50 secured to the side wall of side sections 12 and 13 having an offset section 155 forming a slot 56 receiving therethrough a U-shaped member 157 having one leg 158 extending through slot 56. Leg 158 terminates in a lip 159 at the bottom. A wing nut 57 has an attached threaded shaft 140 extending through a nut 161 and through flange section 155 into engagement with member 157 for selectively tightening against the same and holding it in an up or down position (the "up" position being shown in FIG. 6) with lip 159 about to abut against flange section 155 which acts as a stop.

As seen in FIG. 5, the other leg 156 of the latching mechanism member 157 extends down to a member 162 mounted on the inwardly facing outer wall of side sections 12 or 13 received in a slot 162S in a horizontal lip 163 on leg 156. Cushioning members 164, 165, such as resilient pads, are provided on each side of member 157 secured to member 166 mounted on side of center section 17 or 18. In this manner, when member 157 is in the FIG. 6 position, member 162 is disengaged from the slot 162S in lip 163 and side section 12 can be folded or pivoted over and on top of center section 11. This latching mechanism locks the sections together when assembled as in FIG. 2.

As seen in FIG. 3, a cut-out section 59 is provided at the rear of each side section 12, 13 thereby providing a bar or handle 60 for gripping and transporting the boat 10 when in the FIG. 1 position.

Figure 2:
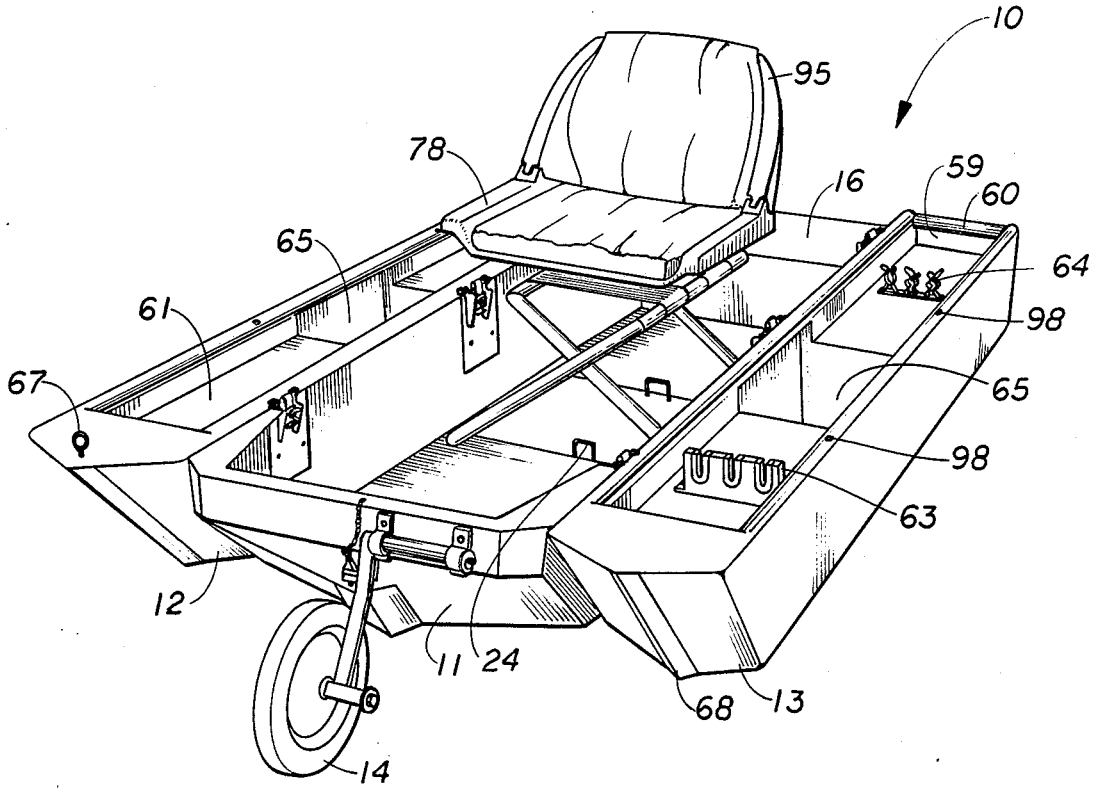
FIG. 2 is a perspective view of the boat of FIG. 1 shown in its fully open position.
Figure 7:
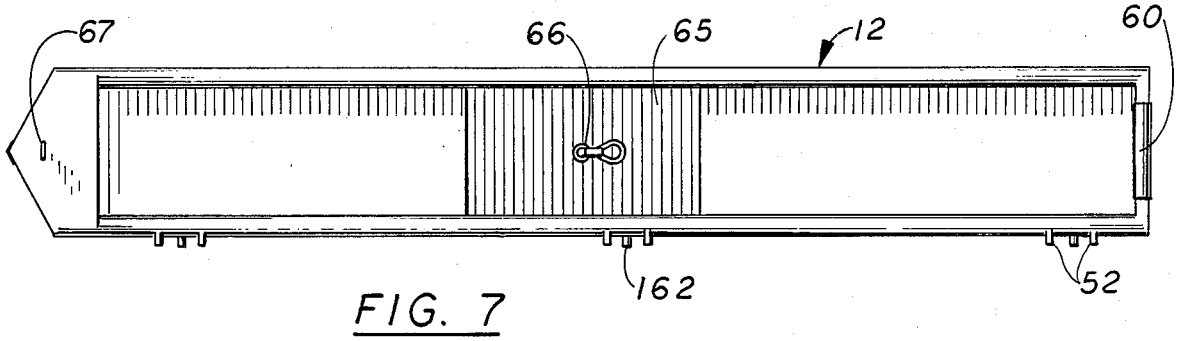
FIG. 7 is a top plan view of one of the side sections of the boat removed therefrom.

As seen in FIG. 2, the inner surface 61 of side section 12 may be used for storage, such as for oars, tackle box, etc. The inner surface 62 of side section 13 may be provided with spaced front and rear rod supports 63, 64 for receiving one or more fishing rods therein as is well known in the art. Also, as seen in FIG. 7, a live bait well or fish well 65 may be provided in one or both of the side sections 12 or 13 with a removable drain plug 66 for removing water therefrom. If desired, eye hooks 67 may be provided at the forward end in each side section 12 or 13 for securely tying a line or the like thereto. Holes 98 to mount oar locks may be provided.

As seen in FIG. 1, resilient bumpers 68 are provided along the outside of side section 12 and 13 for providing cushioning of blows to the front and rear of the boat 10 when in use. Also, as seen in FIG. 1, the flanges 161 may extend down along the sides of side sections 12 and 13 as shown and have cushioning members 161, 165 for cushioning the abutment of each side section 12 and 13 when in the FIG. 2 position.

Figure 8:
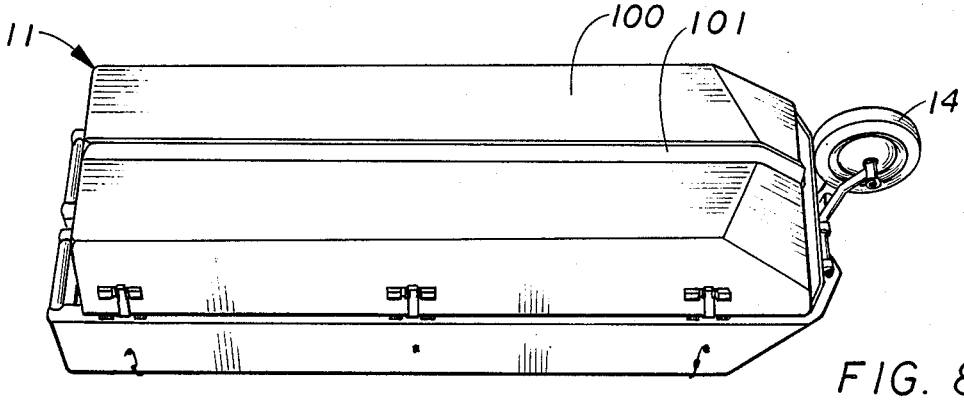
FIG. 8 is a bottom perspective view of the center section of the boat of the invention.

As seen in FIG. 8, a reinforcing keel 101 may extend along the flat bottom 100 of the center section 11.

As seen in FIG. 2, a chair 78 may be mounted in the interior of center section 11 supported on bottom wall 19 or 23. As seen in FIG. 1, a plate 79 having a hook 162 may be provided on the outer surface of each end of each side sections 12 and 13 (only side section 13 is visible in FIG. 1) for receiving a conventional tie-down strap (not shown) about each section 12 or 13 for engaging hooks 162 for securing the sections 12, 13 together in the closed position.

Figure 9:
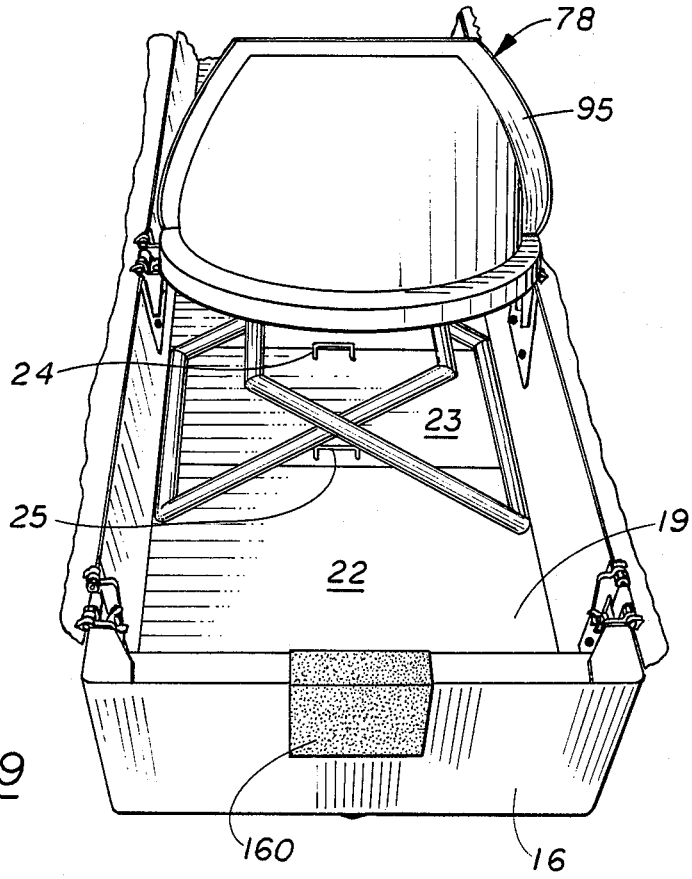
FIG. 9 is a sectional view of the center portion section of the boat of the invention showing a chair mounted therein.

As seen in FIG. 9, chair 78 is shown as having a seat 81 with a plate 82 (FIG. 10) secured to the underside by nuts and bolts 83 extending through plate 82 into a second or lazy Susan bearing plate 84 secured to the underside of seat 81. A collapsible frame having a pair of rectangular open preferably tubular frame sections 85 and 86 is mounted to plate 82.

A pair of U-shaped flanges 87 and 88 are secured to the underside of frame 82 receiving therethrough one arm 91 of frame 85. A pair of open curved flanges 89, 90 are provided secured to the opposite side of frame 82 from flanges 87, 88 adapted to snap fittingly receive therein arm 92 of frame 86. These frames 85, 86 are pivotally connected at their intersection by pivot pins 93, 94, as shown, frame 85 being narrower than frame 86 and thus receivable therebetween.

Figure 10:
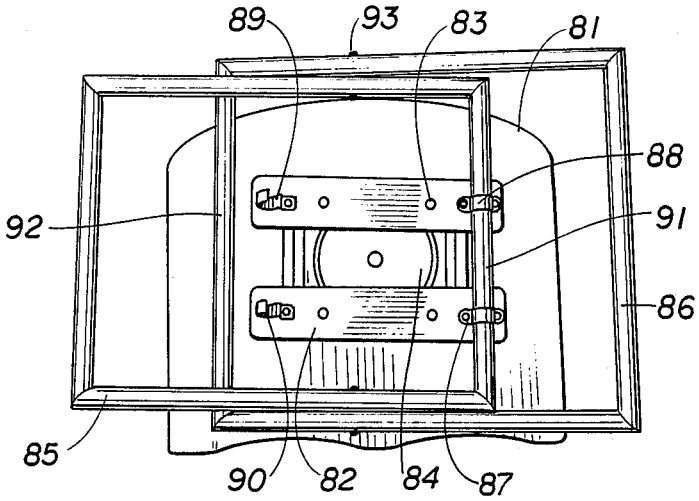
FIG. 10 is a bottom view of the seat of the chair of FIG. 9 with the legs folded.

In this manner, frames 85, 86 may be opened and snapped into flanges 89, 90 so that chair 78 is in the FIG. 9 position, or unsnapped and collapsed, so that chair 78 is in the stored FIG. 10 position.

A suitable back 95 may be provided on seat 81 and, in fact, the seat and back may be one integral unit. Any suitable means may be provided for having the chair collapse to a stored position, then opened to the used FIG. 2 position. The outward extent of frames 85, 86 may be such that the extent is related to the spacing between the inner side walls of center section 11 to provide firm support. The ears 24, 25 may be used to secure frames 85, 86 thereto to provide added support, if desired.

Figure 11:
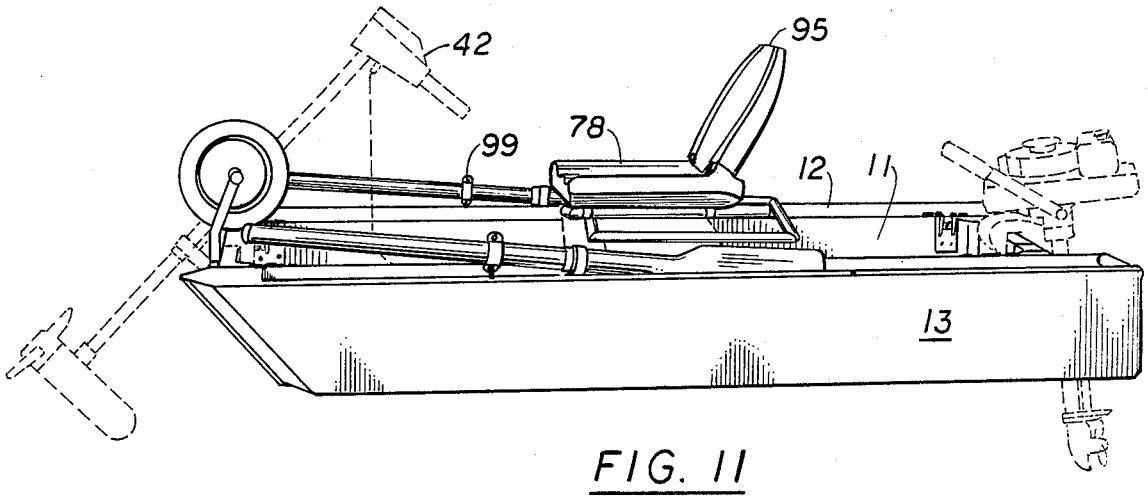
FIG. 11 is a perspective side view of the boat of FIGS. 1 to 10 showing the boat in fully operative position with the chair thereof in the collapsed position.

Although chair 78 is shown in FIG. 2 as in a fully extended upright position, it can also be used in the collapsed position as shown in FIG. 11 without the frame spread out. Also, as seen in FIG. 1, side sections 12, 13 are preferably longer in overall length than center section 11. This is, although they may start flush with center section 11 at the front, they extend slightly longer at the rear. This reduces the spashing of water into the main center section 11 when in use due to the fluid dynamics of device 10 when set up in operative position.

Figure 12:
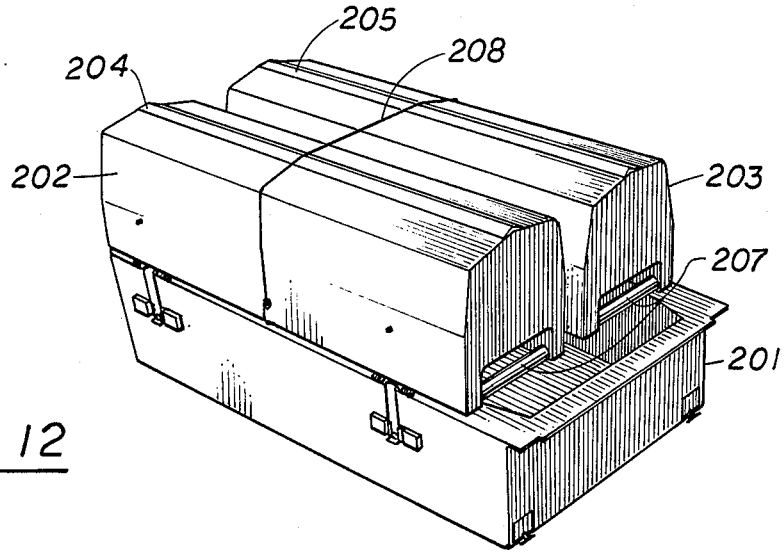
FIG. 12 is a perspective view of a slave unit that may be used with the boat of the subject invention.

As seen in FIG. 12, a slave unit 200 may be provided having a main center section 201 and side sections 202, 203 all connected as discussed hereinabove with respect to boat 10 of FIGS. 1 to 11. Center section 201 may extend beyond sections 202, 203, as shown, and all sections may have a keel as seen on the bottoms of sections 202, 203 (keels 204, 205, respectively). Hand holds 206, 207 may be provided on each section 202, 203 as shown and as previously discussed. A resilient tie down cord 208 is used to hold the sections together.

Figure 13:
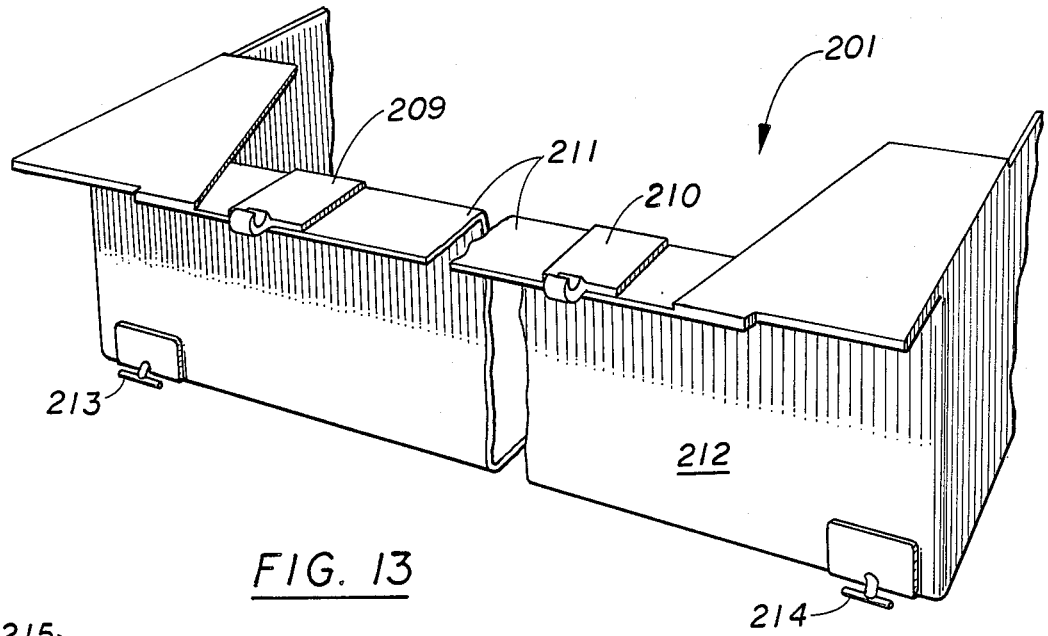
FIG. 13 is a perspective view of the front of the center section of the unit of FIG. 12.

Unit 200 is adapted to be connected to the rear of boat 10 and pulled there along and thus can carry more equipment, another passenger, etc. As seen in FIG. 13, center unit 201 may have at least a pair of upwardly and outwardly curved flanges 209, 210 on upper wall 211, which wall extends beyond the rear vertical back wall 212 as shown. A pair of spaced pins 213, 214 are provided at the bottom of back wall 212 as shown.

Figure 14:
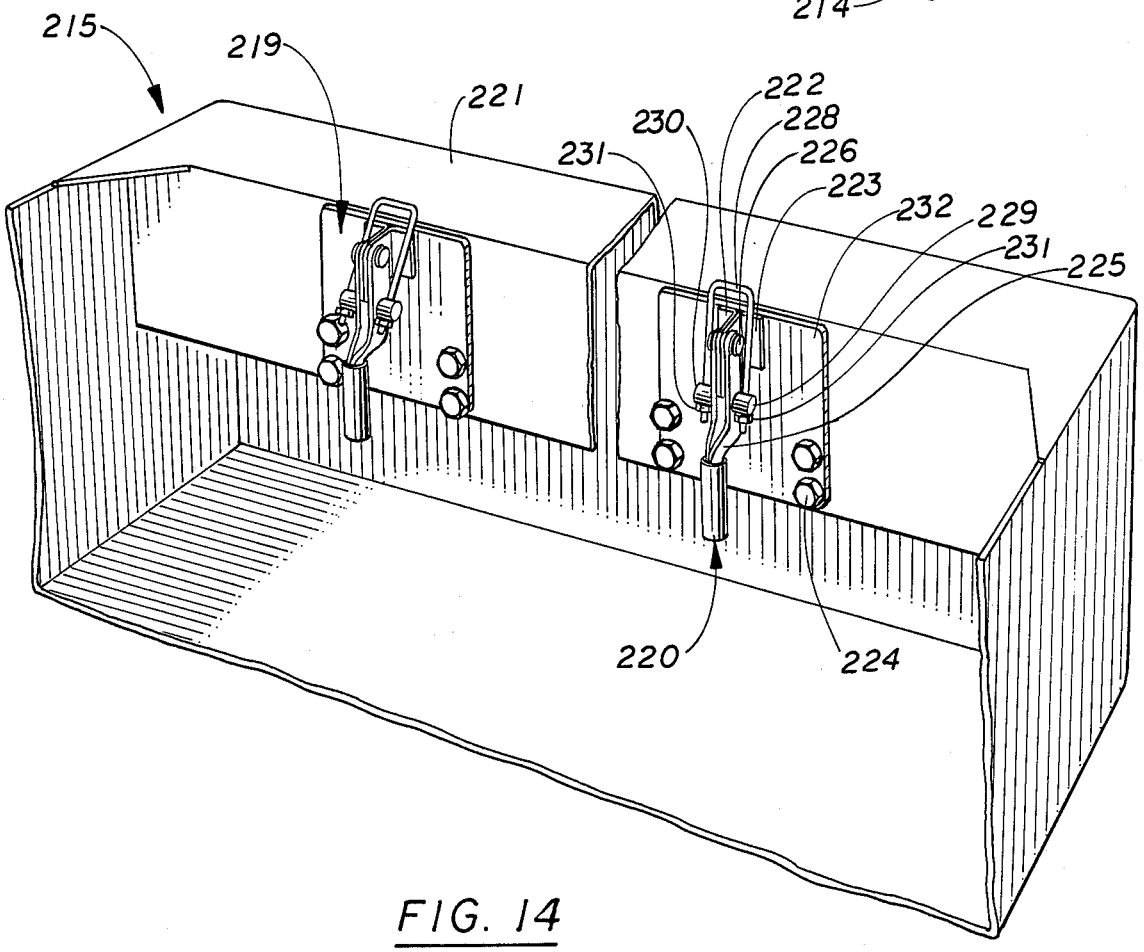
FIG. 14 is a perspective view of a center section similar to that of the boat of FIG. 1 modified to connect the unit of FIGS. 12 and 13 thereto showing part of the latching mechanisms.
Figure 15:
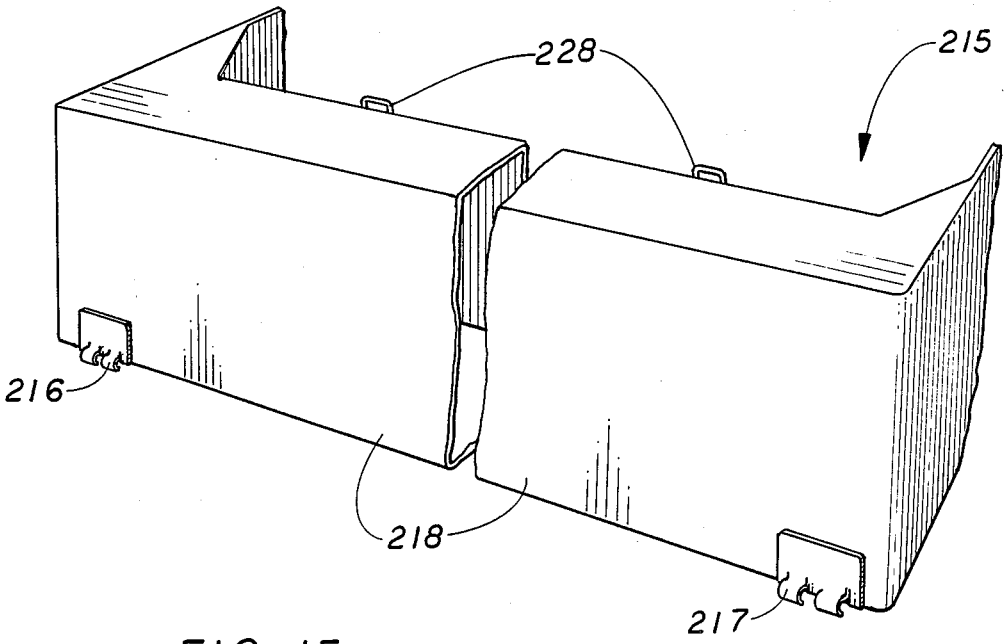
FIG. 15 is a perspective view of a center section similar to that of the boat of FIG. 1 showing the pin receivers.
Figure 16:
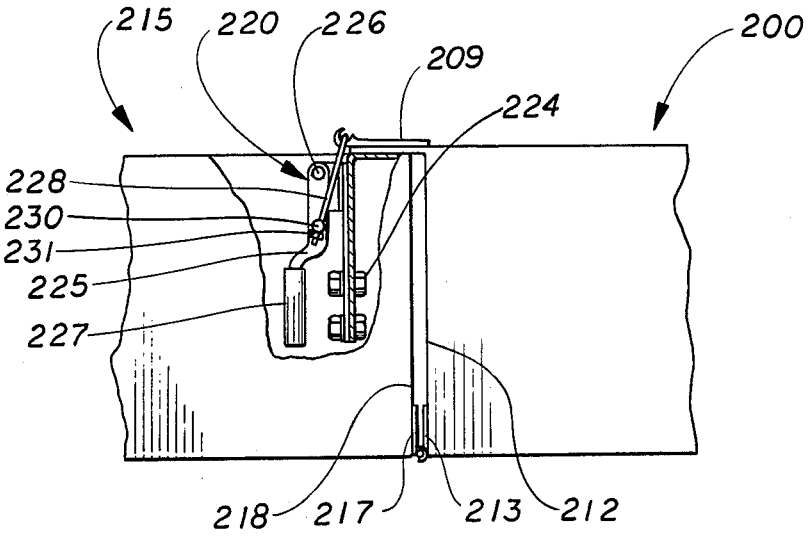
FIG. 16 is a sectional view similar to that of the boat of FIG. 1 showing the latching mechanism of FIGS. 13, 14 and 15.

As seen in FIG. 14, the modified rear of a center section 215, (corresponding to rear center section 16 of section 11 of the boat of FIG. 1), is shown. A pair of spaced pin receiving members 216, 217 are provided at the bottom of rear wall 218 of section 215 adapted to receive pins 213, 214,(See FIG. 13) respectively, therein. A pair of spaced lever assemblies 219, 220 are provided on the vertical inner wall 221 of section 215. (See FIG. 15) Each assembly 219, 220 includes a pair of abutting flange plates 222, 223 secured to wall 221 via nuts and bolts 224. Optionally reinforced by plate 232 with a U-shaped lever 225 straddling the same having a pivot pin 226 retaining the same. Lever 225 terminates in a handle 227 and thus acts as a throw lever. A U-shaped ball 228 extends about the flanges 209, 210 discussed with respect to FIG. 13 on slave unit 200 and has its legs on each side of lever 225 extending through block members 229, 230 coupled to the arms of lever 225 with nuts 231 threaded to the terminal ends of the legs of U-shaped ball 228. In this manner, bail 228 can be selectively tightened and loosened from engagement with flanges 209, 210. Thus, unit 200 can be quickly added to or released from main unit 10.

The entire unit may be lightweight, such as 65 pounds, exclusive of the wheels, motor and chair. The thickness of each side section may be slightly less than 1.2 of the overall width of center section 11 so that it can fold to the FIG. 1 position. Any suitable sizes may be used. The chair may be entirely folded for storage. The boat wells 65 may also be used for stability by merely filling them with water. Plug 66 may be a conventional boat plug that screws in a hole that is threaded and flattens tight. Wells 65 may be used as an ice chest (or to hold an ice chest). The fishing rod supports 63, 64 may be conventional items with spring loaded clamps to hold the rods in place.

The center plate 23 may be used to support a battery for the motor 42 which may be electric. Wheel 14 may be totally removable or foldable.

Suitable hydrodynamical surfaces may be used through out. The motor 42 may be clamped to the front or back and on either side of the centerline of center section 11. In fact, a conventional outboard motor may be mounted on one end with a trolling motor on the other end. Each end transom wall may be roughened accordingly as may be handles or bars 60.

Optional oars with oar locks 99 may be provided. Oars may also be provided and stored on top of chair 78 when in its stored position. If desired, a canopy may be provided that snaps onto the boat 10 at suitable locations, either for storage, or for use in inclement weather.

Thus, the boat 10 can be stored as seen in FIG. 1, lifted by bars 60 and rolled via wheel 14 to the water. The tie down straps are disengaged from hooks 162 and the boat 10 is opened or unfolded to the FIG. 2 position with chair 78 erected as shown and motor 42 mounted on the transom. The boat 10 is ready for launch and wheel 14 may be removed or rotated to the FIG. 4 position as previously discussed. The foregoing is reversed to remove and store boat 10.

Any suitable materials may be used throughout, such as lightweight aluminum. Any suitable non-skid materials, such as adhesive materials, may be used. The boat 10 can support an outboard of a low horsepower, such as 2 H.P. Although the boat 10 is particularly suitable for a single operator, a second chair may be provided and the boat made longer, if desired.

Although a particular embodiment is disclosed, the invention contemplates those features coming within the disclosure herein and not only the specific embodiment disclosed.

Since certain changes may be made in the above apparatus without departing from the scope of the invention herein involved, it is intended that all matter contrary to the above description shall be interpreted as illustrative and not in a limiting sense.

I claim:

1. A portable collapsible folding boat comprising:

a midsection having a generally water-tight enclosure with a bottom wall and interconnected peripheral side, front and rear walls;

a pair of side sections connected to said midsection on each side thereof, each of said side sections having a generally watertight enclosure with a bottom well and interconnected side, front and rear wall; and folding means associated with both said side sections and side midsection for folding said side sections from a first position where the side walls of said side sections are generally co-planar with the side wall of said midsection to a second position wherein said side sections pivot over and onto the top of said midsection with the side walls of said side sections when in the second position being substantially co-planar with the respective side wall of said midsection and spaced from each other including a wheel pivotally mounted to the front wall of said midsection, and wherein the length of each side section is greater than the length of said midsection, and each of said side sections has a handle means integrally formed in the rear wall thereof, whereby when the side sections are in the folded over position, the handles are disposed rearwardly of the rear wall of said midsection.

2. In the boat of claim 1 including wheel storing means associated with said wheel and said midsection for moving said wheel from a first operative position where said wheel engages the surface on which the boat is disposed to a second position where said wheel is stored out of the way and out of engagement with the surface on which the boat is disposed.

3. In the boat of claim 1 including a collapsible chair mounted in said midsection.

4. In the boat of claim 3 wherein said chair includes a seat and a pair of pivotally connected rectangular frames coupled to the underside of said seat, one of said frames being fixedly and pivotally secured to said underside and the other of said frames being snap fitted to said underside.

5. In the boat of claim 1 including a well provided in the bottom wall of one of said side sections.

6. In the boat of claim 5 including a hole in said well communicating the interior of said well with the exterior bottom of said side section and a removable plug mounted in said hold.

7. In the boat of claim 1 including a plurality of fishing rod holders mounted in the interior of one of said side sections.

8. In the boat of claim 1 including a trolling motor mounted to one of said end walls of said midsection.

9. In the boat of claim 1 including a cut-out section in the rear wall of each of said side sections, and a handle formed by said cut-out sections for grasping the same.

10. In the boat of claim 1 including roughened areas on the upper surfaces of the rear and front walls of said midsection.

11. In the boat of claim 1 including a separate slave unit comprising a midsection having a generally watertight enclosure with a bottom wall and interconnected peripheral side, front and rear walls, a pair of side sections connected to said last-mentioned midsection on each side thereof, each of said last-mentioned side sections having a generally watertight enclosure with a bottom wall and interconnected side, front and rear walls, folding means associated with both said last-mentioned side sections and said last-mentioned midsection for folding said last-mentioned side sections from a first position wherein the bottom walls of said last-mentioned side sections are generally co-planar with the bottom wall of said last-mentioned midsection to a second position wherein said last-mentioned side sections pivot over and onto the top of said last-mentioned midsection with the bottom walls of said last-mentioned side sections when in the second position being substantially co-planar with the respective side wall of said last-mentioned midsection and spaced from each other, and means on both said boat and said slave unit for releasably connecting said slave unit, when in the first position thereof, to the rear wall of the first-mentioned mid-section.

12. In the boat of claim 1 wherein the side sections each have an exterior wall, and tie down posts are provided in each exterior wall for securing the side sections in a closed position on top of the midsection.

13. In the boat of claim 12 further including oar locks mounted on each of the side sections.

14. In the boat of claim 1 wherein handles are provided at the end opposite the pivotally mounted wheel for directing the boat on land.

* * * * *